US005964955A

United States Patent [19]

Rochette et al.

[11] Patent Number: 5,964,955

[45] Date of Patent: Oct. 12, 1999

[54] SYSTEM FOR COUPLING OPERATING EQUIPMENT TO A WASHER

[75] Inventors: Daniel Rochette, Charlesbourg; Michel Lemay, Ste-Foy; Yves-Andrébec Theriault, Beauport; Michel Emond, Lévis; Marió Duchaine, Beauport; Ghislain Parent, Cte-Lévis; Nathalie Thibault, Boischatel, all of Canada

[73] Assignee: Steris Corporation, Mentor, Ohio

[21] Appl. No.: 08/970,977

[22] Filed: Nov. 14, 1997

[51] Int. Cl.[6] ..... B08B 7/04; B08B 3/00

[52] U.S. Cl. ..... 134/10; 134/18; 134/36; 134/42; 134/198; 134/201; 134/175

[58] Field of Search ..... 134/198, 201, 134/172, 174, 175, 169 A, 10, 18, 26, 36, 42

[56] References Cited

U.S. PATENT DOCUMENTS

| | | | |
|---|---|---|---|
| 2,448,045 | 8/1948 | Pegg . | |
| 3,195,546 | 7/1965 | Tonkowich et al. . | |
| 3,593,728 | 7/1971 | Sauer | 134/96 |
| 4,402,331 | 9/1983 | Taldo et al. | 134/58 R |
| 4,559,960 | 12/1985 | Lanier | 134/166 |
| 4,637,413 | 1/1987 | Llewllyn et al. | 134/111 |
| 4,650,456 | 3/1987 | Armington | 493/464 |
| 4,653,518 | 3/1987 | Adachi | 134/62 |
| 4,911,188 | 3/1990 | Seidel | 134/56 R |
| 5,016,314 | 5/1991 | Green et al. | 15/320 |
| 5,067,504 | 11/1991 | Coleman, III | 134/172 |
| 5,289,837 | 3/1994 | Betancourt | 134/57 R |
| 5,390,636 | 2/1995 | Baylor et al. | 123/198 A |
| 5,657,781 | 8/1997 | Steverson | 134/144 |

*Primary Examiner*—Frankie L. Stinson
*Assistant Examiner*—Paul J. Lee
*Attorney, Agent, or Firm*—Fay, Sharpe, Beall, Fagan, Minnich & McKee

[57] ABSTRACT

An operating system (20) for a washer (1) is mounted on a moveable trolley (52). The trolley carries all of the failure prone elements such as pumps (24, 28, 40) solenoid valves 80, electrical heaters (48), an electrical control circuit (50) and the like. Quick-release couplings (58, 59,60 62), between the operating system and plumbing associated with a washing chamber (10), allow the operating system to be quickly disconnected from and reconnected with the chamber. The trolley is then wheeled a distance away from the chamber, providing ready access to all the operating equipment for maintenance and repair.

18 Claims, 2 Drawing Sheets

SYSTEM FOR COUPLING OPERATING EQUIPMENT TO A WASHER

BACKGROUND OF THE INVENTION

The present invention relates to the system control arts. It finds particular application in conjunction with washing and disinfecting equipment and will be described with particular reference thereto. It should be appreciated, however, that the invention is also applicable to the control systems for other large scale pieces of equipment, particularly when a number of pieces of mechanical and electrical operating equipment located outside a housing are to be connected to the housing. Animal cages and associated racks are generally cleaned at frequent intervals to remove biological waste, such as urine, feces, and uneaten food. Similarly, large pieces of health care and scientific equipment, such as hospital beds, wheelchairs and carts are cleaned periodically. Thorough cleaning aids in preventing the spread of disease and reduces the development of unpleasant odors. Washers have been developed to handle the large scale cleaning and disinfecting of animal cages and racks and large pieces of scientific and health care equipment. Typically, these are large enough for a load of the cages or equipment to be wheeled manually into a washing chamber. Cleaning fluids are sprayed onto the load, usually under pressure and at elevated temperatures.

Because the environment of the washing chamber is harmful to operating equipment, such as pumps, electrical controls and heaters, the equipment is usually mounted on an outside wall of the chamber, with connections to the chamber being made through the chamber walls. For the typical washer, numerous such connections are made. Installing a new washer is a time consuming process, taking a week or more for the operating equipment to be mounted on the washing chamber and the connections made.

Periodically, pieces of the operating equipment are repaired or replaced. Access to the pieces is often difficult because of the arrangement and number of pieces surrounding the washing chamber. Sometimes several pieces are removed in order to gain access to the piece needing repair. Further, repairs are sometimes best carried out in a workshop, away from the washer, where suitable analysis and repair equipment is available. The piece of operating equipment to be repaired is therefore unmounted from the washing chamber and transported to the workshop.

The present system overcomes these problems and others.

SUMMARY OF THE INVENTION

In accordance with one aspect of the present invention, a system for coupling operating equipment to a washing chamber of a washer is provided. The system includes a moveable trolley for supporting the operating equipment for the washer, the trolley being disposed adjacent an exterior wall of the washing chamber. The system also includes releasable couplings for connecting the operating equipment to the washing chamber.

In accordance with another aspect of the present invention a washing system is provided. The system comprises a plurality of walls which define a washing chamber, a plurality of nozzles mounted to the walls for spraying liquid into the washing chamber, a fluid conduit extending from the nozzles to a first fitting of a nozzle releasable coupling, a sump disposed below the washing chamber for receiving fluid sprayed from the nozzles, a sump outlet extending from adjacent the bottom of the sump to a first fitting of a sump releasable coupling, trolley including a frame assembly mounted on wheels or rollers, at least one cleaning fluid vessel mounted to the trolley frame, a first pump mounted to the trolley frame assembly and connected with the cleaning fluid vessel and a second fitting of the nozzle releasable coupling which is selectively connectable with and disconnectable from the first fitting of the nozzle releasable coupling, the pump pumping cleaning fluid from the cleaning fluid vessel to the nozzles, and a sump pump connected with the cleaning fluid vessel and a second fitting of the sump releasable coupling, the second fitting of the sump releasable coupling being selectively connected with and disconnected from the sump first fitting of the sump releasable coupling, the sump pump pumping cleaning fluid from the sump to the cleaning fluid vessel.

In accordance with yet another aspect of the present invention, a method of repairing a washer is provided. The method comprises a washing system as described immediately above and further including a supply container, containing a cleaning fluid concentrate, mounted to the trolley frame, a metering pump connected with the supply container and the cleaning fluid vessel for selectively pumping metered quantities of cleaning fluid concentrate into the cleaning fluid vessel, a water inlet for selectively suppling water to the cleaning fluid vessel. The method comprises the steps of disconnecting the first and second fittings of the nozzle releasable coupling and the first and second fittings of the sump releasable coupling, rolling the trolley to a remote location, diagnosing components on the trolley to identify a source of failure, repairing failed components on the trolley, rolling the trolley back adjacent the washing chamber, and reconnecting the first and second fittings of the nozzle releasable coupling and the first and second fittings of the sump releasable coupling.

One advantage of the present invention is that it enables the operating system to be connected to a washer or other controlled system in a short period of time.

Another advantage of the present invention is that the operating equipment is easily uncoupled from the washing or other controlled system for repair or replacement of pieces of the operating equipment.

Another advantage is that the operating system is readily transported to testing equipment and comprehensive repair facilities.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
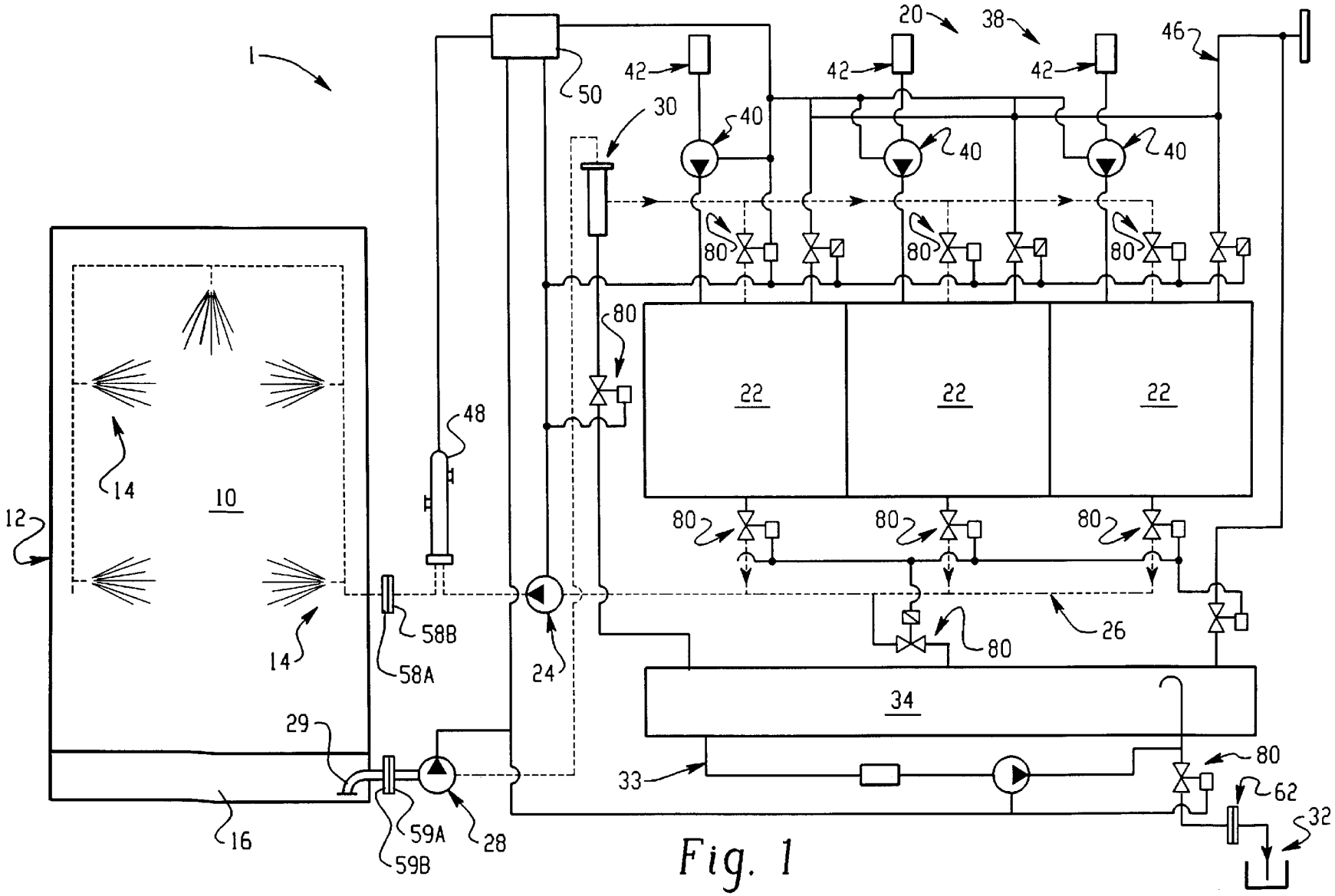
FIG. 1 is a schematic of a preferred embodiment of a washer according to the present invention.

With reference to FIG. 1 a washer 1 includes an interior washing chamber 10. An exterior wall 12 encloses the chamber 10. Spray nozzles 14, disposed within the chamber spray cleaning fluid over a load to be processed. A sump 16 is located beneath the washing chamber 10 and collects the used fluid as it drips down from the washing chamber.

Operating equipment 20, disposed exterior to the washing chamber 10, supplies the cleaning fluid to the chamber, removes used fluid from the sump 16, and controls the operation of the spray nozzles 14 and other parts of the washer, such as doors, lights, and the like. The operating equipment is described with reference to a preferred embodiment. It is to be understood, however, that the operating equipment may comprise any combination of pieces of equipment, supply vessels and the like, which for ease of access, or for other reasons, such as incompatibility with the washing chamber environment during a cleaning cycle, are disposed exterior to the chamber.

The operating equipment 20 includes cleaning fluid tanks or vessels 22, which supply cleaning and disinfecting fluid to a first pump 24, through a fluid line or conduit 26. The pump 24 pumps the cleaning fluid to the spray nozzles 14. A sump pump 28 directs the used cleaning fluid from a sump outlet 29, extending from adjacent the bottom of the sump, to a filtration device 30 and the tanks 22 or to a drain 32, through a drain line 33. Before disposal, the fluid passes through a cool down vessel 34 where the temperature and pH of the fluid are adjusted to meet environmental standards. A detergent injection system 38, including metering pumps, such as peristaltic pumps 40, periodically supplies fresh concentrated cleaning and disinfecting fluids to the tanks 22 from supply containers 42 to maintain cleaning fluid concentration levels. A water inlet 46 supplies water to the tanks 22 to dilute the incoming concentrated fluid. In a typical cycle, the cleaning fluid is replenished at intervals by discarding a selected portion of the cleaning fluid that has circulated through the washing chamber 10. The tank is refilled with water and a supplemental charge of fresh detergent is added. A temperature booster 48 heats the cleaning fluid prior to reaching the nozzles. An electrical or electronic control circuit 50 regulates the operation of the operating equipment 20 and other parts of the washer, such as doors, a drier, and the like, according to the type of cleaning cycle selected.

Figure 2:
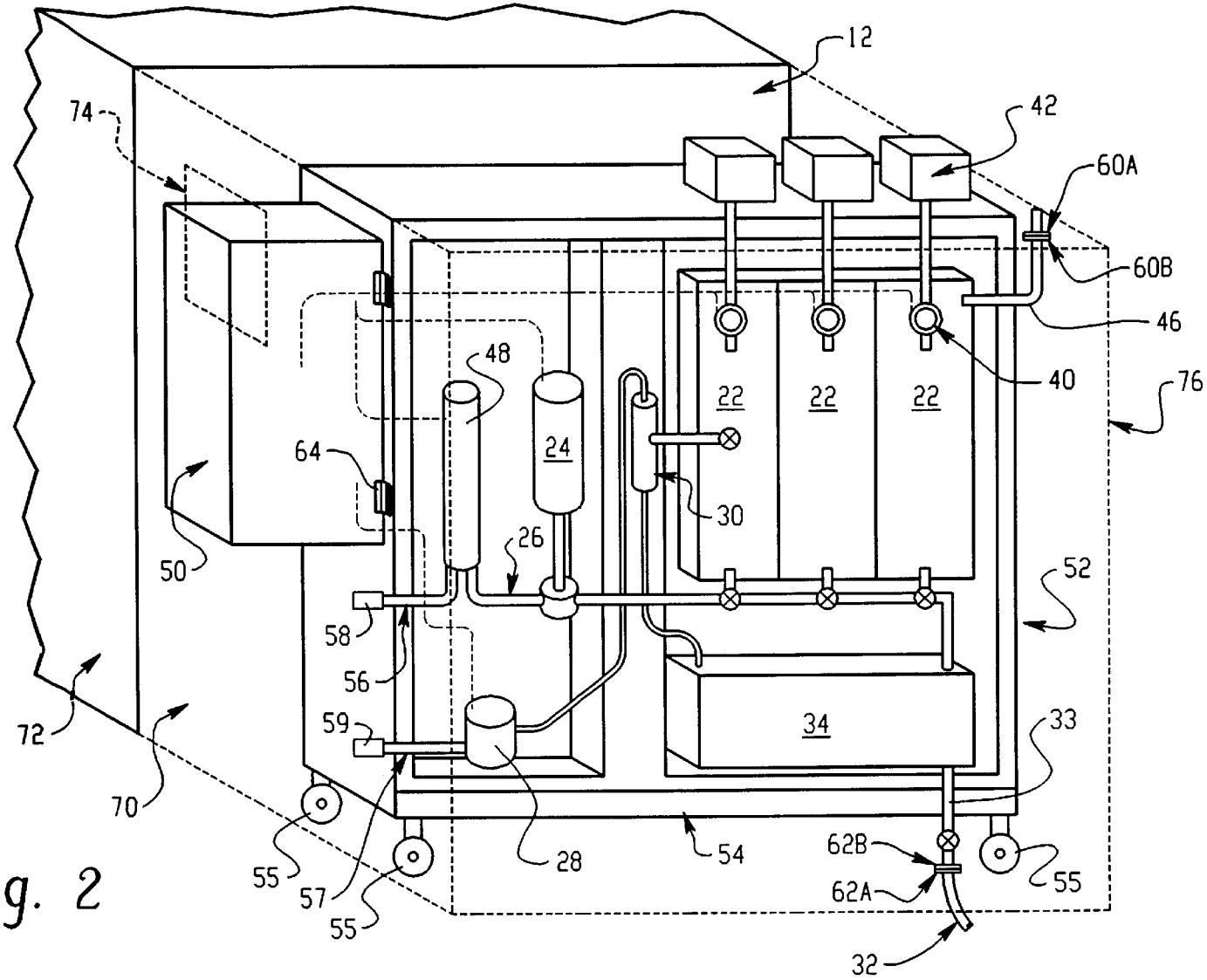
FIG. 2 is a side view of the washer of FIG. 1, with a coupled equipment trolley.

With continued reference to FIG. 1 and reference also to FIG. 2, a moveable trolley 52 is located adjacent the exterior wall 12. The trolley includes a mounting frame assembly 54 for mounting the operating equipment 20 and wheels, castors or rollers 55 for wheeling the trolley around a facility in which the washing chamber is located. Preferably, castor locks are provided on the wheels.

A trolley outlet 56 in fluid line 26 supplies fluid from the first pump 24 to the nozzles and a trolley inlet 57 receives used cleaning fluid from the sump 16. First and second releasable couplings, 58, 59, connected to the trolley outlet and inlet, respectively, and disposed exterior to the washing chamber 10, provide fluid connections between the operating equipment and the spray nozzles 14, and sump 16, respectively. A similar releasable coupling 60 also connects the water inlet 46 to a water supply, and another releasable coupling 62 connects the cooldown tank 34 with the drain 32. Each of the releasable couplings 58, 60, 62 includes first and second fittings, denoted A and B respectively. The first fitting 58A, 60A, 62A, in each case, is disposed further from to the operating equipment 20 and releasably couples with the second fitting 58B, 60B, 62B, respectively.

Preferably the trolley 52 when loaded with the operating equipment 20 is about one meter or less in width and about two meters or less in height so that the trolley passes easily through doors (not shown)of standard height and width in the facility. When installing a new washer, the operating equipment is preferably mounted to the trolley before leaving the factory, thereby reducing installation time.

When access to pieces of the operating equipment is required, such as when repairs are to be made, the operating equipment 20 is uncoupled from the washing chamber 10 by releasing the couplings 58. Preferably, the couplings are of a quick-connecting type, allowing the couplings to be uncoupled or coupled in a short period of time. The trolley 52 is then wheeled a distance away from the washing chamber to provide access to the operating equipment 20 for repairs. If the trolley is to be moved to another site, electrical power is unplugged and the water inlet and drain are disconnected, by releasing releasable couplings 60 and 62. For more complex repairs, the trolley and mounted operating equipment is wheeled to a repair shop.

In addition, some pieces of the operating equipment, such as the control circuit 50, are mounted to the trolley frame 54 with hinges 64, which allow the pieces of operating equipment to swing away from the trolley, thereby providing access to other pieces of the operating equipment without uncoupling from the operating equipment.

For cosmetic and safety purposes, a removable access panel 70 optionally extends from a front wall 72 of the washer. The panel 70 shields the trolley and the operating equipment from view. The access panel includes a switch panel 74 which includes switches for operating the washer, such as for opening and closing doors, commencing a wash cycle, and the like. Electrical connections connect the switch panel with the control circuit 50. The switch panel is preferably removable from the access panel so that it can be transported with the trolley for repairs. Alternatively, the electrical connections are of a quick release type. Optionally, the washer includes a cosmetic shell 76, which surrounds the trolley. The access panel provides a wall of the cosmetic shell. Other access openings are included .n the shell as desired.

Optionally, electrically operated solenoid valves 80 control the flow of fluid into and out of the cleaning fluid vessel and to a drain, respectively. The solenoid valves are mounted on the trolley and electrically connected with the electrical control circuit to be controlled thereby.

While the preferred embodiment has been described with respect to a washer 1, it should be appreciated that other large, stationary fluid systems which receives fluid under pressure and returns spent fluid under reduced pressure may alternatively replace the washer.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A system for operating a washing which includes a washing chamber, which receives items to be washed and spray nozzles mounted int he washing chamber for washing the received items, the system including:

a moveable trolley for supporting operating equipment for operating the washer, the operating equipment including a control system for controlling the operation of the washer and a first pump for pumping cleaning fluid to the washing chamber spray nozzles for washing the items, the trolley disposed adjacent an exterior wall of the washing chamber; and, releasable couplings for connecting some of the operating equipment to the washer while the items are washed, the releasable couplings including:

a first set of mating couplings for fluidly connecting the first pump with the washing chamber spray nozzles to deliver the cleaning fluid to the washing chamber spray nozzles, and a second set of mating couplings for fluidly connecting the washing chamber with a return fluid line on the trolley.

2. The system of claim 1, wherein the trolley includes wheels for moving the trolley.

3. The system of claim 1, wherein the trolley, when loaded with operating equipment, is about one meter wide or less and about two meters in height or less so that it passes easily through standard sized doors.

4. The system of claim 1, further including:

at least one of a cleaning fluid vessel and a waste fluid cool down tank, mounted to the trolley;

a sump defined at a bottom of the washing chmaber for receiving cleaning fluid from the chamber, the sump being connected with the second set of mating couplings such that the second set of mating couplings fluidly connect the sump with the return fluid lind; and, the return fluid line being connected with at least one of the cleaning fluid vessel and the waste fluid cool down tank.

5. The system of claim 4, wherein the operating equipment further includes:

a second pump fluidly connected between the second set of couplings and the at least one of the cleaning fluid vessel and the waste fluid cool down tank for pumping the cleaning fluid from the washing chamber sump to the at least one of the cleaning fluid vessel and the waste fluid cool down tank, the second pump being mounted to the trolley.

6. The system of claim 5, wherein the control system is connected with the first pump, the second pump, a metering pump, and an in-line tempature booster for controlling the operation thereof in accordance with a selected washing cycle.

7. The system of claim 4, further including:

a drain line fludily connected with one of the second pump and the cleaning fluid cool down vessel for draining spent cleaning fluid to an external drain for disposal.

8. The system of claim 7, further including a plurality of eletrically operated solenoid valves for controlling flow of fluid into and out of the cleaning fluid vessel and to the drain, the solenoid valves being mounted on the trolley and eletrically connected with the control system to be controlled thereby.

9. The system of claim 4, further including:

a supply container of concentrated cleaner fluid mounted to the trolley;

a metering pump connected with the supply container and the cleaning fluid vessel for selectively pumping metered quanities of concentrated cleaning fluid into the cleaning fluid vessel; and, a third set of releasable couplings for connecting a water supply with the cleaning fluid vessel for selectively suppling water to the cleaning fluid vessel.

10. The system of claim 1, further including an in-line tempature booster mounter to the trolley and connected between the first pump and the first set of releasable couplings for heating cleaning fluid in transit to the spray nozzles.

11. The system of claim 1, wherein the trolley is supported on wheels such that when the first and second sets of mating couplings are disconnected, the trolley is rollable to a remote location for maintenance and repair of the operating equipment for operating the washer.

12. An easily repaired fluid handling device comprising:

a large, stationary fluid system which receives fluid under pressure and returns spent fluid, the system including:

an outer cosmetic housing;

a plurality of spray nozzles for spraying the pressurized fluid;

a stationary system first coupling portion;

a stationary system second fluid coupling portion;

plumbing permanently mounted to the system (i) for conveying the fluid under pressure from the first coupling portion to the nozzles and (ii) for returning the spent fluid to the second coupling portion;

a trolley which is removably received within the outer cosmetic housing, the trolley including:

a trolley frame which is supported on a plurality of casters;

a series of fluid pumps, valves, and fluid tanks mounted to the trolley for receiving the fluid at a trolley fluid inlet and suppling the fluid under higher pressure at a trolley first fluid coupling portion;

an electronic control circuit mounted to the trolley for controlling the pumps and valves;

a first releasable coupling connecting assembly for fluidly connecting the trolley first fluid coupling portion and the stationary system first fluid coupling portion;

a trolley second fluid coupling portion fluidly connecting with a trolley fluid inlet;

a second releasable coupling connecting assembly for fluidly connecting the trolley second fluid coupling portion and the stationary system second fluid coupling portion;

the trolley being selectively received in the cosmetic housing of the stationary system with the trolley and stationary system first and second fluid coupling portions fluidly connected during normal operation and being removed from the cosmetic housing by disconnecting the first and second releasable coupling connecting portions and rolling the trolley away from the device for easy access for maintenance and repair.

13. A method of servicing the device of claim 12, comprising:

decoupling the first and second releasable coupling connecting assemblies;

rolling the trolley to a remote location;

servicing at least one of the fluid pumps, the valves, and the electronic control circuit;

rolling the trolley back to the stationary system and positioning the trolley in the cosmetic housing;

recoupling the first and second releasable coupling connecting assemblies.

14. A method for coupling operating equipment to a washer which includes a washing chamber for receiving items to be washed and spray nozzles mounted in the washing chamber for spraying cleaning on the received items, the method including:

mounting the operating equipment to a moveable trolleys the operating equipment including pumping equipment for pumping cleaning fluid to the washing chamber for washing the items;

moving the trolley until it is adjacent an exterior wall of the washing chamber;

connecting the operating equipment to the washing chamber with releasable couplings, including:

coupling a first set of the releasable couplings to fluidly connect the pumping equipment with the washing chamber spray nozzles; and, pumping washing fluid from the trolley, through the releasable coupling to the spray nozzles, and washing the received items.

15. The method of claim 14, further including:

disconnecting the first set of releasable couplings to disconnect the operating equipment from the washing chamber spray nozzles;

moving the trolley a distance away from the washing chamber; and, making repairs to the operating equipment.

16. The method of claim 15, further including, after the step of moving the trolley a distance away from the washing chamber:

moving the trolley back adjacent the washing chamber;

reconnecting the releasable couplings to reconnect the operating equipment with the washing chamber.

17. The method of claim 14, wherein the washer includes a sump which receives cleaning fluid from the washing chamber, and wherein the step of coupling the operating equipment further includes:

coupling a second set of the releasable couplings to fluidly connect the sump with a fluid vessel on the trolley.

18. The method of claim 14, further including:

pumping the cleaning fluid from the fluid vessel through the first set of releasable couplings to the nozzle and spraying the cleaning fluid on the received items;

collecting sprayed cleaning in the sump; and, pumping cleaning fluid from the sump through the second set of releasable couplings to the fluid vessel, such that the cleaning fluid is recirculated during a washing cycle.

* * * * *